US009714571B2

(12) United States Patent
Tao

(10) Patent No.: US 9,714,571 B2
(45) Date of Patent: Jul. 25, 2017

(54) SAMPLING TOOL WITH A MULTI-PORT MULTI-POSITION VALVE

(71) Applicant: Schlumberger Technology Corporation, Sugar Land, TX (US)

(72) Inventor: Chen Tao, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 417 days.

(21) Appl. No.: 14/359,332

(22) PCT Filed: Nov. 30, 2012

(86) PCT No.: PCT/US2012/067307

§ 371 (c)(1),
(2) Date: May 20, 2014

(87) PCT Pub. No.: WO2013/082433

PCT Pub. Date: Jun. 6, 2013

(65) Prior Publication Data

US 2014/0299383 A1 Oct. 9, 2014

Related U.S. Application Data

(60) Provisional application No. 61/566,565, filed on Dec. 2, 2011.

(51) Int. Cl.
*E21B 49/10* (2006.01)
*E21B 49/08* (2006.01)

(52) U.S. Cl.
CPC ..... *E21B 49/081* (2013.01); *E21B 49/10* (2013.01)

(58) Field of Classification Search
USPC ..... 166/100
See application file for complete search history.

(56) References Cited

U.S. PATENT DOCUMENTS

| | | | | |
|---|---|---|---|---|
| 3,430,713 | A * | 3/1969 | Lanmon | E21B 49/06 175/78 |
| 3,859,851 | A | 1/1975 | Urbanosky | |
| 5,398,725 | A | 3/1995 | Nakazawa et al. | |
| 2008/0245569 | A1 * | 10/2008 | Nold | E21B 49/10 175/24 |
| 2011/0073193 | A1 | 3/2011 | Eccles et al. | |
| 2011/0139448 | A1 | 6/2011 | Ciglenec et al. | |

FOREIGN PATENT DOCUMENTS

| | | | | |
|---|---|---|---|---|
| GB | WO 2008032126 | A1 * | 3/2008 | E21B 43/121 |
| WO | 98/10168 | A1 | 3/1998 | |

OTHER PUBLICATIONS

International Search Report for International Application No. PCT/US2012/067307 dated Mar. 28, 2013.

* cited by examiner

*Primary Examiner* — David Andrews
*Assistant Examiner* — Ronald Runyan
(74) *Attorney, Agent, or Firm* — Michael Dae

(57) ABSTRACT

A downhole sampling tool includes a cam configured to rotate about a central axis. Two or more pistons engage a cam track such that rotation of the cam causes the pistons to reciprocate between first and second piston positions. Corresponding fluid flow lines are opened and closed when corresponding ones of the plurality of pistons reciprocate between the first and second piston positions.

20 Claims, 4 Drawing Sheets

SAMPLING TOOL WITH A MULTI-PORT MULTI-POSITION VALVE

FIELD OF THE INVENTION

Disclosed embodiments relate generally to sampling subterranean formation fluids and more specifically to a downhole formation fluid sampling tool having a multi-port multi-position valve.

BACKGROUND INFORMATION

In order to successfully exploit subterranean hydrocarbon reserves, information about the subsurface formations and formation fluids intercepted by a wellbore is generally required. This information may be obtained via sampling formation fluids during various drilling and completion operations. The fluid may be collected and analyzed, for example, to ascertain the composition and producibility of hydrocarbon fluid reservoirs.

Downhole sampling tools commonly include a fluid entry port (or probe), one or more packers for isolating the fluid entry port from the remainder of the borehole, a fluid inlet valve, and one or more sampling chambers. Owing to the potential for obtaining contaminated samples, it is sometimes desirable to collect multiple samples using a single sampling tool. Sampling tools configured for obtaining multiple samples, commonly include a large number of inlet valves (and corresponding electronic control circuitry) connected to various fluid flow lines. While such tools may be serviceable, increased tool complexity can lead to reliability problems, especially in high temperature, high pressure wellbore environments.

Therefore there is a need in the art for improved formation fluid sampling tools, particularly for obtaining multiple fluid samples.

SUMMARY

A formation fluid sampling tool having at least one multi-port, multi-position valve is disclosed. The valve includes a cam configured to rotate about a central axis. The cam may be rotated, for example, via an electric motor or via hydraulic power. Two or more pistons engage a cam track such that rotation of the cam causes the pistons to reciprocate between first and second positions. Corresponding sampling flow lines are opened when corresponding ones of the plurality of pistons are in the first position and closed when the corresponding ones of the plurality of pistons are in the second position. The valve may optionally be configured to provide fluid communication between a common input flow line and individual ones of the sampling flow lines when the corresponding ones of the plurality of pistons are in the first position.

The disclosed embodiments may provide various technical advantages. For example, disclosed embodiments enable multiple sequential formation fluid samples to be collected. The use of a single inlet valve enabling collection of such multiple samples tends to reduce tool complexity and therefore may improve tool serviceability and reliability.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
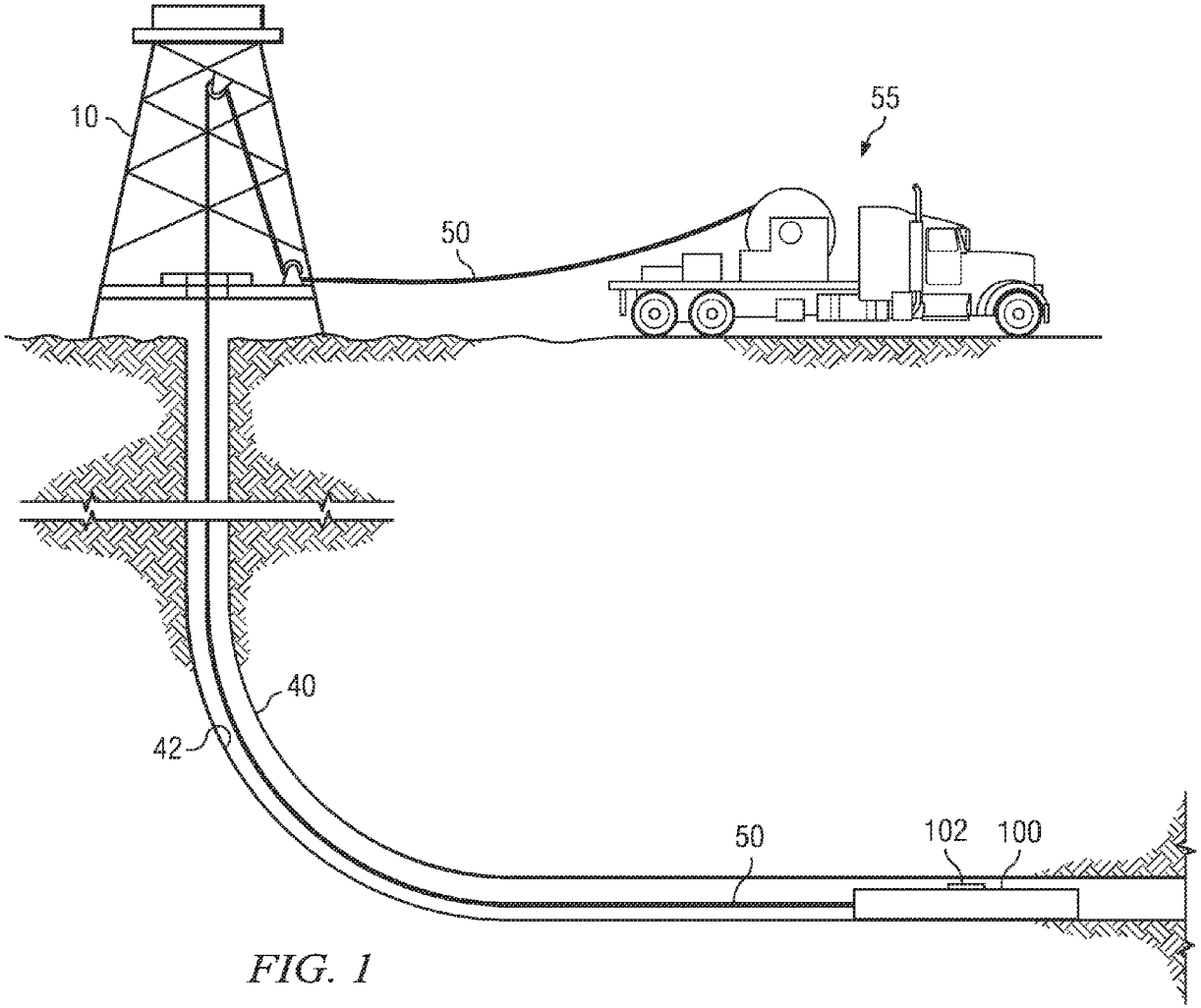
FIG. 1 depicts one example of a drilling rig on which disclosed sampling tool embodiments may be utilized.

FIG. 1 depicts a drilling rig 10 suitable for employing certain wireline tool embodiments disclosed herein. In the depiction, a rig 10 is positioned over (or in the vicinity of) a subterranean oil or gas formation (not shown). The rig may include, for example, a derrick and a hoisting apparatus for lowering and raising various components into and out of the wellbore 40. A downhole wireline sampling tool 100 is deployed in the wellbore 40. The sampling tool may be connected to the surface, for example, via a wireline cable 50 which is in turn coupled to a wireline truck 55.

During a wireline operation, sampling tool 100 may be lowered into the wellbore 40. In a highly deviated borehole, the sampling tool 100 may alternatively or additionally be driven or drawn into the borehole using, for example, a downhole tractor or other conveyance means. The disclosed embodiments are not limited in this regard. For example, sampling tool 100 may also be conveyed into the borehole 40 using coiled tubing or drill pipe conveyance methodologies.

The example wireline sampling tool 100 described herein may be used to obtain multiple samples of subterranean formation fluids such as heavy oil and bitumen and may therefore include a plurality of sample bottles (e.g., three, four, five, six or more bottles). Each of the sample bottles (not shown) may have various functionality, such as, for example, zero dead volume (flashing line), self-sealing functionality, and/or being nitrogen-charged (as described in more detail below). Sampling tool 100 may further include a probe assembly 102 for establish fluid communication between the sampling tool 100 and the subsurface formation. During a sampling operation, the probe 26 may be extended into contact with the borehole wall 42 (e.g., through a mud cake layer). Formation fluid samples may be drawn into the sampling tool 100 through the probe assembly 102 (e.g., via a pump).

The probe assembly 102 may include a probe mounted in a frame (the individual probe assembly components are not shown). The frame may be configured to extend and retract radially outward and inward with respect to the sampling tool body. Moreover, the probe may be configured to extend and retract radially outward and inward with respect to the frame. Such extension and retraction may be initiated via an uphole or downhole controller. Extension of the frame into contact with the borehole wall 42 may further support the sampling tool in the borehole as well as position the probe adjacent the borehole wall.

In some embodiments, such as those used in low permeability formations, the probe assembly 102 may be replaced by packer assembly (not shown). The disclosed embodiments are not limited in this regard. As is known to those of ordinary skill in the art, a packer assembly, when inflated, is intended to seal and/or isolate a section of the borehole wall to provide a flow area with which to induce fluid flow from the surrounding formation.

While FIG. 1 depicts a wireline sampling tool 100, it will be understood that the disclosed embodiments are not so limited. For example, sampling tool 100 may include a drilling tool such as a measurement while drilling or logging while drilling tool configured for deployment on a drill string. The disclosed embodiments are not limited in these regards.

Figure 2:
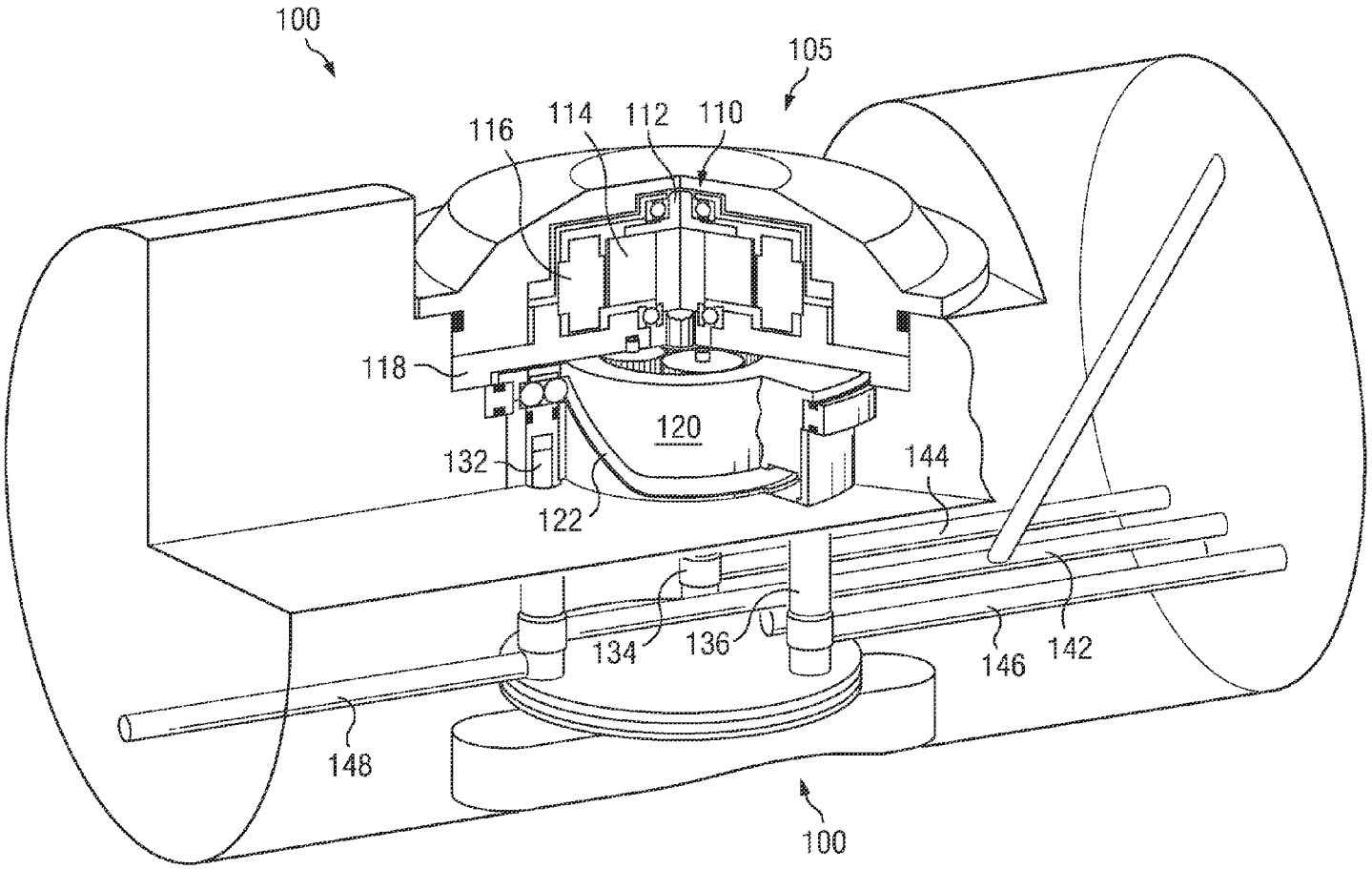
FIG. 2 depicts a cutaway view of a portion of a disclosed sampling tool including a multi-port, multi-position valve.
Figure 3:
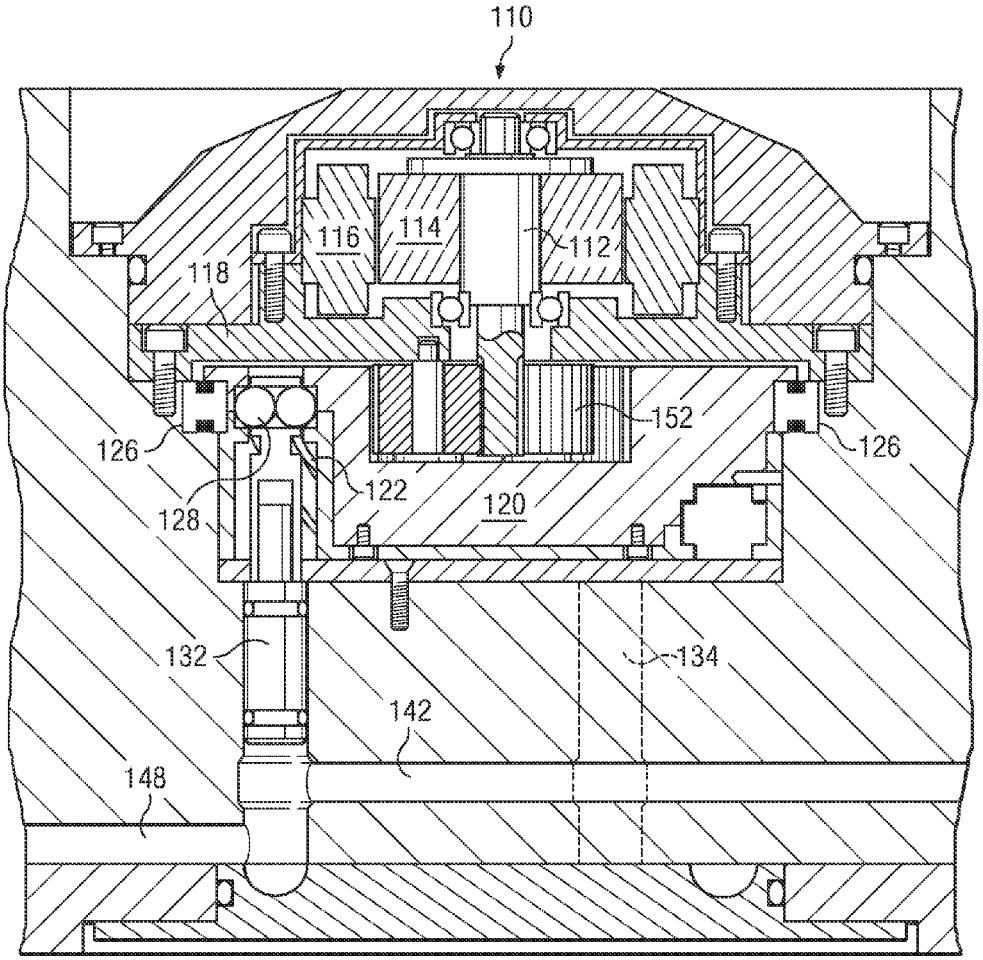
FIG. 3 depicts a cross sectional view of the sampling tool shown on FIG. 2.

FIGS. 2 and 3 depict a partial cutaway view (FIG. 2) and a cross sectional view (FIG. 3) of sampling tool 100. In the depicted embodiment, sampling tool 100 includes a multi-port multi-position valve 105 which may sequentially open and close first, second, and third flow lines 142, 144, and 146 which are in fluid communication with corresponding first, second, and third sample bottles (not shown). It will be understood that the multi-port, multi-position valve 105 may be configured to open and close substantially any number of flow lines (e.g., from 3 to 6) and may therefore include a corresponding number of pistons (e.g., from 3 to 6). In the depicted embodiment, motor 110 rotates cam 120 which guides pistons 132, 134, and 136 along internal cam track 122 so as to open and close the flow lines 142, 144, and 146.

Motor 120 includes a rotor 112 and stator 114 deployed in a motor housing 116. Rotation of the rotor 112 causes a corresponding rotation of cam 120 via gearing mechanism 152. Bearings 126 support cam 120 and provide for relative rotation of the cam with respect to the tool body and motor housing 118. Cam 120 includes an internal cam track 122. Pistons 132, 134, and 136 ride in the cam track 122. Bearings 128 secure the pistons in the track 122 and enable the cam 120 to rotate with respect to the pistons 132, 134, and 136 (such that the pistons ride in the track 122). The pistons 132, 134, and 136 engage cam track 122 such that rotation of the cam moves the pistons in corresponding piston cylinders (according to the shape of the track) in a direction substantially parallel with a rotational axis of the cam 120. For example, when the track 122 becomes more recessed in the cam 120, the piston is retracted into (pulled towards) the cam (e.g., as depicted with respect to piston 132). When the track 122 becomes less recessed, the piston is pushed away (extended outward) from the cam. In the depicted embodiment, retraction of a piston into the cam 120 opens the corresponding flow line. Extension of the piston away from the cam 120 closes the flow line.

Figure 4A:
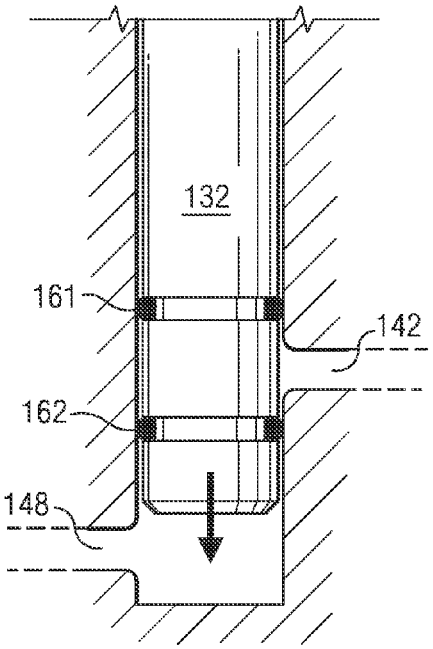
FIGS. 4A and 4B depict a piston in opened (FIG. 4B) and closed (FIG. 4A) positions.
Figure 4B:
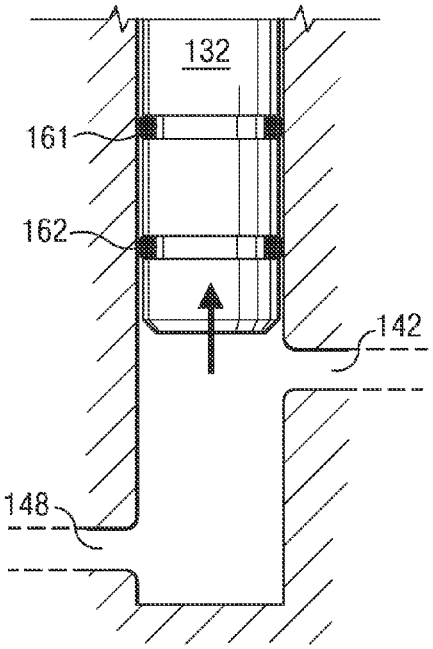

FIGS. 4A and 4B depict piston 132 in the closed (FIG. 4A) and opened (FIG. 4B) positions. In the depicted embodiment, first and second o-ring seals 161 and 162 are deployed about pistons 132. The o-rings 161 and 162 may be configured to provide an adequate seal at downhole conditions such as at 25,000 psi at 300 degrees F. When piston 132 is extended away from the cam 120, o-rings 161 and 162 are positioned about flow line 142, thereby closing the flow line. As depicted, seal 162 provides a seal between input flow line 148 and sample bottle flow line 142. When the piston is retracted, seal 162 is positioned above flow line 142 thereby providing fluid communication between the input flow line 148 and the sample bottle flow line. A chamfer may be provided at the entry point of flow line 142 to provide unobstructed flow between the input flow line 148 and flow line 142. The disclosed embodiments are of course not limited in this regard. Nor are the disclosed embodiments limited to any particular sealing (o-ring) configuration. Moreover, the disclosed embodiments are not limited to a valve actuation mechanism in which a flow line is opened via retraction of a piston and closed via extension of the piston. Other alternative configurations are possible.

With continued reference to FIG. 4 and reference again to FIGS. 2 and 3, wireline sampling tool 100 may include a shared input flow line 148 (shared in the sense that input flow line 148 may be in fluid communication with flow lines 142, 144, or 146 depending on the position of the cam). Formation fluid may be drawn into input flow line 148, for example, via the operation of a probe assembly or packer assembly (e.g., as described above with respect to FIG. 1). In order to obtain a formation fluid sample, motor 110 is actuated so as to rotate the cam 120. Rotation of the cam causes movement of the pistons with respect to the track 122 (e.g., bearings 128 roll along the track). When the track maintains a zero slope in the region of a piston, that piston remains in its current position (e.g., closed) during cam rotation. However, when a portion of the track that is sloped reaches a piston, the piston may be caused to moved (e.g., thereby opening the flow line as described above). As the piston moves, a void is created in the cylinder enabling fluid to flow from the input flow line 148 through the piston cylinder to the flow line. It will be appreciated that the fluid flow rate and the sampling volume may be controlled by the motion and position of the piston.

In the particular embodiment shown on FIGS. 2 and 3, sampling tool 100 includes three distinct flow lines 142, 144, and 146 in fluid communication with corresponding sample bottles (not shown). Pistons 132, 134, and 136 are spaced at substantially equal angle intervals (120 degrees) about the cam 120. In the starting position (zero degrees) all three pistons are extended out from the cam 120 such that the valve 105 is fully closed (there is no fluid communication between input fluid line 148 and any of flow lines 142, 144, and 146). When the cam rotates 60 degrees, the first piston 132 is retracted into the cam 120 thereby providing fluid communication between input flow line 148 and flow line 142 (and a first sample bottle). An additional 60 degree rotation (to 120 degrees) extends the first piston 132 away from the cam 120 and closes the valve 105. When the cam is rotated to 180 degrees, the second piston 134 is retracted into the cam 120 thereby providing fluid communication between input flow line 148 and flow line 144 (and a second sample bottle). An additional 60 degree rotation (to 240 degrees) extends the second piston 132 away from the cam 120 and closes the valve 105. When the cam is rotated to 300 degrees, the third piston 136 is retracted into the cam 120 thereby providing fluid communication between input flow line 148 and flow line 146 (and a third sample bottle). An additional 60 degree rotation (back to zero degrees) extends the third piston 132 away from the cam 120 and closes the valve 105.

In the depicted embodiment, only one of the flow lines 142, 144, and 146 (and therefore sample bottles) may be opened at a given time (while the others are closed). The disclosure, however, is not limited in this regard. The cam track may readily be shaped such that multiple flow lines (and therefore sample bottles) are opened and/or closed simultaneously. The shape of the cam track may be configured based on the number of pistons and the amount of movement required for each piston to open and close the flow lines. In some embodiments, the slope of the track may be less than forty-five degrees and/or the travel on the track from open to closed may be more than twice the piston movement required for opening or closing. The size and configuration of the track may vary depending on the application. The shape of the track is intended to govern the sampling arrangement. Modifications may therefore be made to the track to alter the sampling technique.

Figure 5:
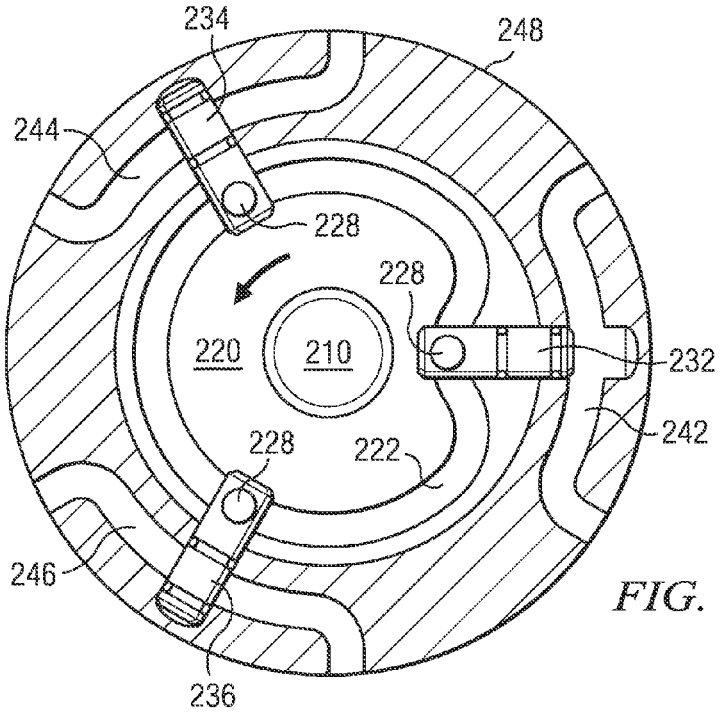
FIG. 5 depicts an alternative radial valve embodiment of a multi-port, multi-position valve.

FIG. 5 depicts an alternative embodiment of a multi-port, multi-position valve 205 that may be used to open and close fluid flow lines 242, 244, and 246 (and corresponding sample bottles). Valve 205 may be actuated by a motor 210 or hydraulically. Multi-port, multi-position valve 205 is similar to valve 105 (depicted on FIGS. 2 and 3) in that it includes a plurality of pistons 232, 234, and 236 that engage a cam 220 via bearings 228. Changes in the slope of the cam track 222 cause the pistons 242, 244, and 246 to retracted radially inward and outward (towards and away) from the center of the cam 220 (in a direction substantially perpendicular to a rotational axis of the cam). Retraction of a piston opens fluid flow between a shared input flow line 248 and a corresponding one of the flow lines 242, 244, and 246. In the depiction of FIG. 5, piston 232 is retracted radially inward thereby opening fluid flow line 242. Pistons 234 and 236 are radially extended outward thereby closing fluid flow lines 244 and 246. Cam 220 differs from cam 120 primarily in that it includes an external track 222 about the periphery thereof.

It will be understood that disclosed sampling tools may include sampling bottles having functionality. For example, the bottles may be configured to eliminate or 'zero' dead volume contained therein. Dead volume is a term used to indicate the volume that exists between the seal valve at the inlet to a sample cavity, such as, for example, a sample bottle, of a sample chamber and the sample cavity itself. In operation, this volume is typically filled with a fluid, gas and/or a vacuum. Likewise, the sample chambers in the rest of the flow system are filled with a fluid, gas and/or a vacuum. However, a vacuum is undesirable in many instances because a large pressure drop may result when the seal valve is opened. Thus, many high quality samples may be taken using "low shock" techniques wherein the dead volume is almost always filled with a fluid, usually water. This fluid is often swept into and/or mixed with the formation fluid when a sample is collected, thereby contaminating the sample. Moreover, determination that a sample bottle is full may be obtained, for example, by monitoring the flowline pressure.

The sample bottles may further have self-sealing functionality. A bottle with a self-sealing mechanism prevents fluid from entering therein when a probe or other tool is detached from the downhole sampling tool. The self-sealing mechanism may be configured so as to withstand a high mud flow rate in a mud channel encountered in a wellbore.

Sampling bottles may also be nitrogen-charged. Nitrogen charging may manipulate the pressure within a sampling chamber or bottle. After the successful capture of the sample, the piston causes the sample flow line to be obstructed to seal the fluid sample inside the sample bottle. The sample is then maintained at or above reservoir pressure during retrieval by the release of a pre-set nitrogen charge. The nitrogen in the bottle may exert pressure onto the sample. The pressure is created through a floating piston acting on a buffer fluid, such as, for example, synthetic oil, thus avoiding nitrogen contamination of a sample. The recovery pressure may be set at several thousand psi (or hundred MPa) above the bubble point pressure. In the case of asphaltene studies, the recovery pressure may be set above the reservoir pressure.

Although downhole sampling tool having a multi-position muli-port valve and certain advantages thereof have been described in detail, it should be understood that various changes, substitutions and alternations can be made herein without departing from the spirit and scope of the disclosure as defined by the appended claims.

What is claimed is:

1. A downhole sampling tool comprising:
- a pump configured to draw formation fluid samples into the downhole sampling tool;
- a multi-port multi-position valve, comprising:
  - a cam configured to rotate about a central axis, the cam including a cam track; and
  - a plurality of pistons engaging the cam track, such that rotation of the cam causes the pistons to reciprocate between first and second piston positions; and
- a plurality of fluid flow lines fluidly coupled to the multi-port multi-position valve that are opened and closed when corresponding ones of the plurality of pistons of the multi-port multi-position valve reciprocate between the first and second piston positions.

2. The downhole sampling tool of claim 1, wherein the pistons reciprocate in a direction substantially parallel with the central axis of the cam.

3. The downhole sampling tool of claim 1, wherein the pistons reciprocate in a direction substantially perpendicular to the central axis of the cam.

4. The downhole sampling tool of claim 1, further comprising a motor disposed to rotate the cam about the central axis.

5. The downhole sampling tool of claim 1, further comprising an input flow line that is in fluid communication with corresponding ones of the plurality of flow lines when said flow lines are opened.

6. The downhole sampling tool of claim 5, wherein the input flow line is in fluid communication with a sampling probe.

7. The downhole sampling tool of claim 1, wherein a single rotation of the cam sequentially opens and closes each of the plurality of flow lines.

8. The downhole sampling tool of claim 1, wherein each of the plurality of pistons engages the cam track via a bearing, the bearing configured to ride on the cam track as the cam rotates.

9. The downhole sampling tool of claim 1, wherein each of the plurality of pistons reciprocates between first and second extended and retracted positions with respect to the cam.

10. The downhole sampling tool of claim 9, wherein:
- each of the flow lines are closed when corresponding ones of the plurality of pistons are in the extended positions; and
- each of the flow lines are opened when corresponding ones of the plurality of pistons are in the retracted positions.

11. The downhole sampling tool of claim 1, comprising from three to six pistons.

12. A downhole sampling tool comprising:
- a pump configured to draw formation fluid samples into the downhole sampling tool;
- a multi-port multi-position valve, comprising:
  - a cam configured to rotate about a central axis, the cam including a cam track;
  - a plurality of pistons engaging the cam track, such that rotation of the cam causes the pistons to reciprocate between first and second piston positions;
- a plurality of sampling flow lines fluidly coupled to the multi-port multi-position valve that are opened when corresponding ones of the plurality of pistons of the multi-port multi-position valve are in the first position and closed when the corresponding ones of the plurality of pistons are in the second position; and a common input flow line that is in fluid communication with individual ones of the sampling flow lines when the corresponding ones of the plurality of pistons are in the first position.

13. The downhole sampling tool of claim 12, wherein the pistons reciprocate in a direction substantially parallel with the central axis of the cam.

14. The downhole sampling tool of claim 12, wherein the pistons reciprocate in a direction substantially perpendicular to the central axis of the cam.

15. The downhole sampling tool of claim 12, further comprising a motor disposed to rotate the cam about the central axis.

16. The downhole sampling tool of claim 12, wherein a single rotation of the cam sequentially opens and closes each of the plurality of sampling flow lines.

17. The downhole sampling tool of claim 12, wherein each of the plurality of pistons engages the cam track via a bearing, the bearing configured to ride on the cam track as the cam rotates.

18. The downhole sampling tool of claim 12, wherein each of the plurality of pistons reciprocates between first and second extended and retracted positions with respect to the cam.

19. The downhole sampling tool of claim 18, wherein:

each of the flow lines are closed when corresponding ones of the plurality of pistons are in the extended positions; and each of the flow lines are opened when corresponding ones of the plurality of pistons are in the retracted positions.

20. The downhole sampling tool of claim 12, comprising from three to six pistons.

* * * * *